US007128145B2

(12) United States Patent
Mickey

(10) Patent No.: US 7,128,145 B2
(45) Date of Patent: Oct. 31, 2006

(54) HIGH EXPANSION SEALING DEVICE WITH LEAK PATH CLOSURES

(75) Inventor: Clint E. Mickey, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 214 days.

(21) Appl. No.: 10/223,170

(22) Filed: Aug. 19, 2002

(65) Prior Publication Data

US 2004/0031605 A1 Feb. 19, 2004

(51) Int. Cl.
*E21B 23/06* (2006.01)
*E21B 33/128* (2006.01)

(52) U.S. Cl. ..... 166/179; 166/387; 277/338; 277/340; 277/654

(58) Field of Classification Search ..... 166/192, 166/195, 196, 135, 118, 387, 179; 277/338, 277/340, 652, 654
See application file for complete search history.

(56) References Cited

U.S. PATENT DOCUMENTS 3,288,222 A * 11/1966 Urbanosky ..... 166/192
3,529,667 A * 9/1970 Malone ..... 166/387
3,554,280 A 1/1971 Tucker
3,559,733 A * 2/1971 Kilgore ..... 166/134
3,776,561 A 12/1973 Haney
4,424,861 A * 1/1984 Carter et al. ..... 277/334
4,482,086 A * 11/1984 Wagner et al. ..... 277/337
4,554,973 A * 11/1985 Shonrock et al. ..... 166/192
4,632,406 A * 12/1986 Akkerman ..... 277/565
5,010,958 A * 4/1991 Meek et al. ..... 166/382
5,101,908 A * 4/1992 Mody ..... 166/387
5,579,839 A * 12/1996 Culpepper ..... 166/118
5,695,008 A * 12/1997 Bertet et al. ..... 166/187
5,941,313 A 8/1999 Arizmendi
6,142,227 A * 11/2000 Hiorth et al. ..... 166/123
6,318,461 B1 11/2001 Carisella
6,595,283 B1 * 7/2003 Turley et al. ..... 166/195
6,843,315 B1 * 1/2005 Coronado et al. ..... 166/196
6,902,008 B1 * 6/2005 Hirth et al. ..... 166/387

* cited by examiner

*Primary Examiner*—David Bagnell
*Assistant Examiner*—Shane Bomar
(74) *Attorney, Agent, or Firm*—Steve Rosenblatt

(57) ABSTRACT

A high expansion packer or bridge plug is described. It features an external portion of a soft material that flows into spiral exterior leak paths formed when the sealing element is subjected to longitudinal compression. Preferably, the sealing element is an elastomer such as cured rubber, while the outer material is a soft uncured or somewhat cured rubber. The outer covering may itself be covered for protection when running in with such protective covering breaking or otherwise getting out of the way during the element compression process. As a result of compression, the soft material occupies the exterior helical or other leak paths for a sufficient length along the sealing element to withstand high differential pressures, without leakage.

22 Claims, 4 Drawing Sheets

HIGH EXPANSION SEALING DEVICE WITH LEAK PATH CLOSURES

FIELD OF THE INVENTION

The field of this invention is downhole high expansion sealing devices, such as packers or bridge plugs, that use sealing elements that are compressed, and more particularly to features that close leak paths created peripherally on the compressed sealing element.

BACKGROUND OF THE INVENTION

Frequently, in a variety of downhole operations, portions of the wellbore need to be isolated. Regardless, of the procedure going on at the time, be it drilling, completion or workover, the tool frequently employed is a packer or bridge plug, which may or may not be retrievable. Frequently, the sealing element is one or more long cylindrical elastomeric members mounted over a mandrel. Setting involves longitudinal compression of the sealing element, with provisions at the ends to prevent extrusion. Longitudinal compression reduces the overall length of the sealing elements and increases their diameter. Frequently, to hold differential forces in excess of thousands of pounds, the sealing element assembly could be set with applied forces of 16,000 or more.

A close examination of the shape changes undergone by the initially cylindrical sealing elements reveals that a twisting effect occurs. It can take the form of a single helical external groove as the compressive load initiates a twisting movement. It can also take the form of opposing exterior helical grooves to the twist imparted to the elements as they are longitudinally compressed.

This buckling phenomenon is illustrated in FIGS. 1 and 2 for the prior designs. In FIG. 1, the sealing element 10 is shown in part in the run in condition where it has a generally cylindrical shape around a mandrel 12. As a result of longitudinal compression, the element 10 takes a spiral shape with a series of points labeled point A moving away from mandrel 12, while at the same elevation but 180 degrees around the outer surface 14, point B moves toward the mandrel 10. Although a single helical pattern 16 is shown in a rather open helix, as a result of the high setting forces applied, the actual appearance of the pattern of helical groove or grooves 16 is more closely akin to elongated narrow void areas in close contact with the casing 18, as shown in FIG. 3.

The system of peripheral grooves 16 is problematic in that it represents potential helical leak paths around the outside of the element 10 regardless of the amount of applied longitudinal compression. Although this phenomenon is a distinct disadvantage, prior designs have configures the sealing element to deliberately undergo such helical collapse pattern under longitudinal pressure on the theory that sealing performance is improved. In U.S. Pat. No. 6,318,461 disc shaped components are used for the sealing element to promote the exterior helical recessed areas but no recognition is given as to the detrimental effects. FIG. 9 of that patent illustrates the exterior spiral present after compression. This reference shows that those working in the field have heretofore had no appreciation that the tendency of elongated cylindrical shapes to twist as they collapse from longitudinal loading could present a situation degrading the desired seal after high expansion of the elements. The apparatus of the present invention recognizes this problem and deals with it in a simple and effective manner. The nature of the solution will be appreciated by those skilled in the art from a review of the description of the preferred embodiment and the claims, which appear below.

SUMMARY OF THE INVENTION

A high expansion packer or bridge plug is described. It features an external portion of a soft material that flows into spiral exterior leak paths formed when the sealing element is subjected to longitudinal compression. Preferably, the sealing element is an elastomer such as cured rubber, while the outer material is a soft uncured or somewhat cured rubber. The outer covering may itself be covered for protection when running in with such protective covering breaking or otherwise getting out of the way during the element compression process. As a result of compression, the soft material occupies the exterior helical or other leak paths for a sufficient length along the sealing element to withstand high differential pressures, without leakage.

DETAILED DESCRIPTION OF THE PREFERRED EMBODIMENT

Figure 1:
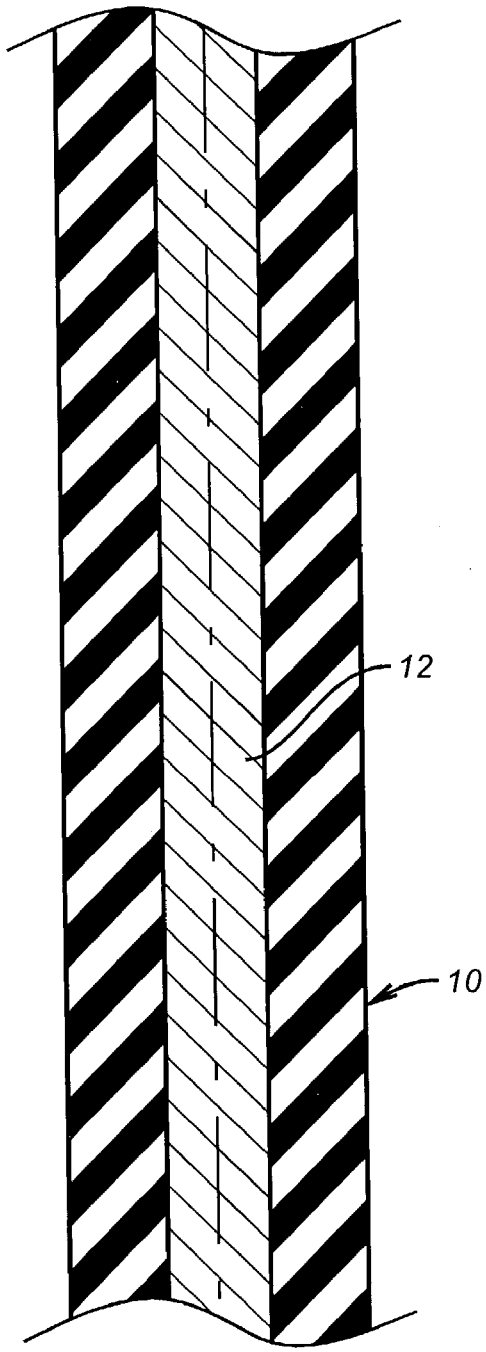
(PRIOR ART) FIG. 1
FIG. 1 is a section view of a known sealing element in the run in position.
Figure 2:
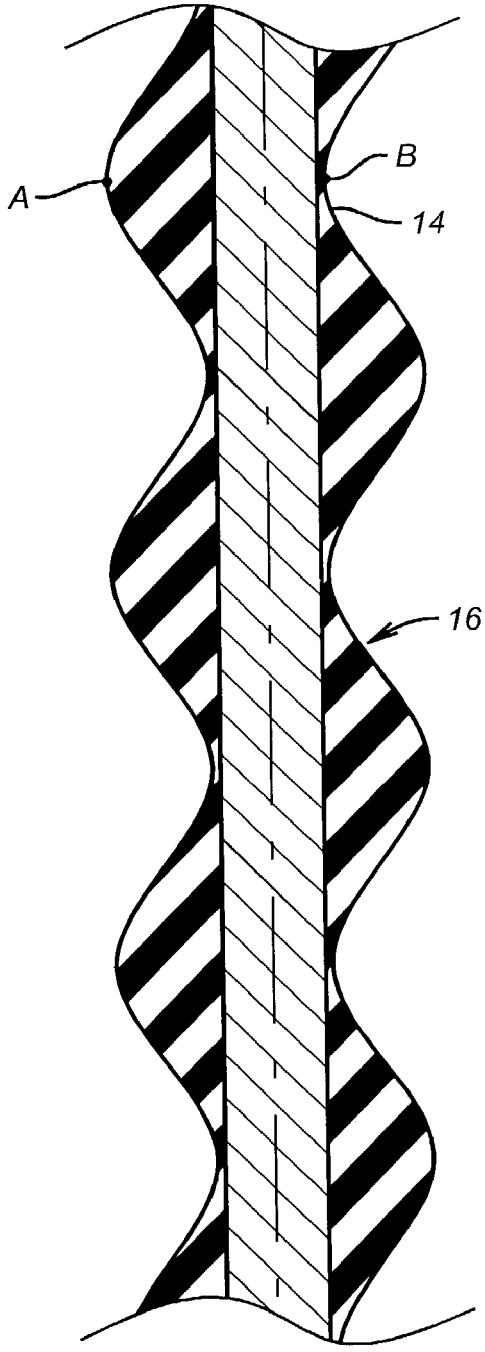
(PRIOR ART) FIG. 2
FIG. 2 is the view of FIG. 1 shown in an exaggerated manner after longitudinal compression to show the helical twisting resulting from compression.
Figure 3:
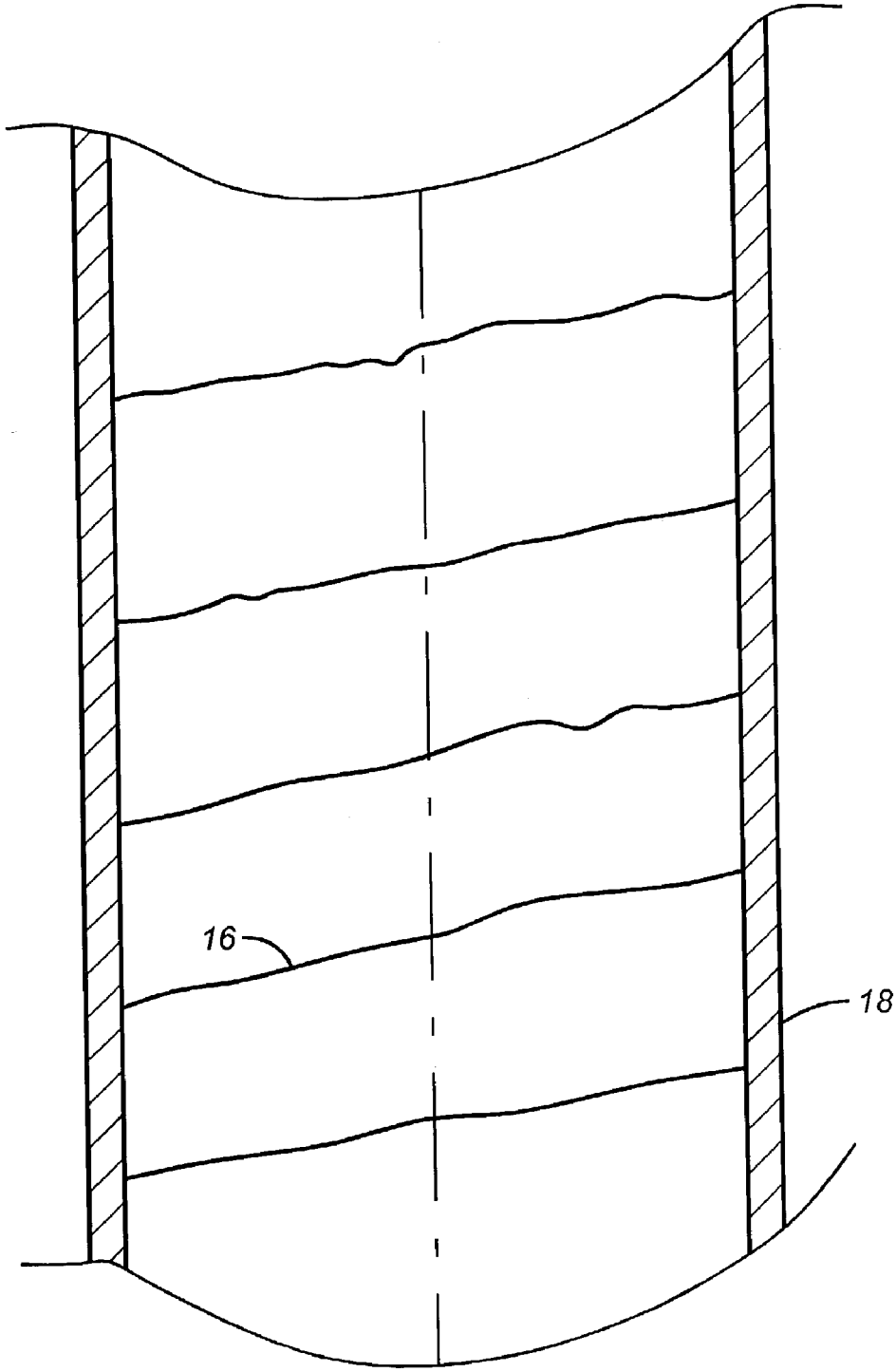
(PRIOR ART) FIG. 3
FIG. 3 is the view of FIG. 2 to show the exterior leak paths resulting from longitudinal compression as they actually appear.
Figure 4:
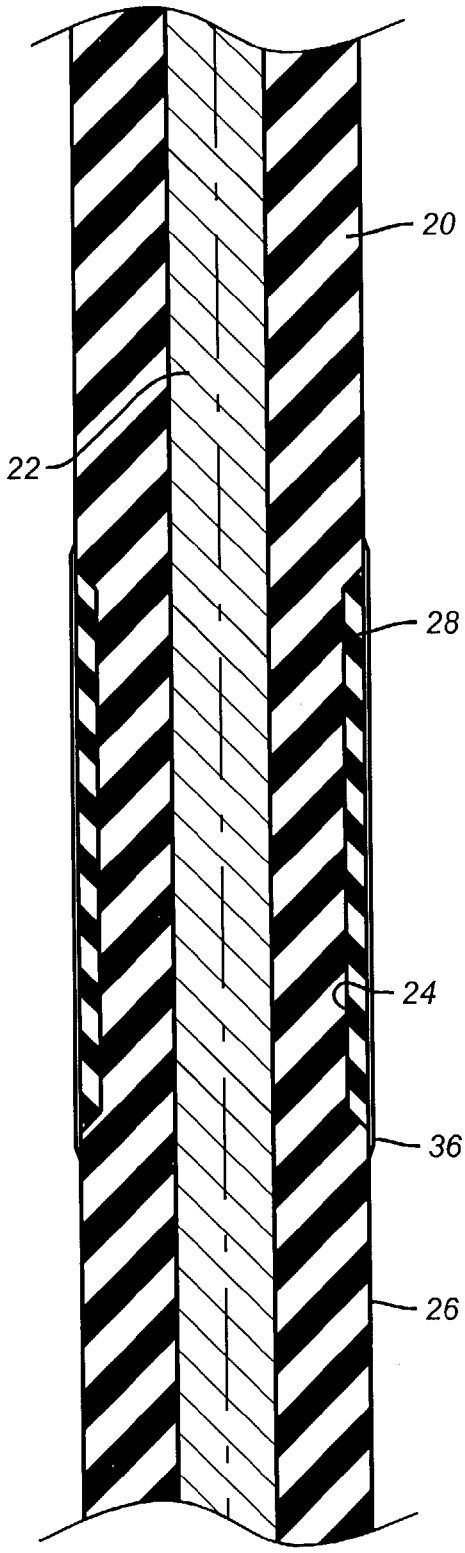
FIG. 4 is a section view of the apparatus of the present invention in the run in position schematically illustrating that the grooves can be oriented parallel, transverse or other orientations to the longitudinal axis of the mandrel.
Figure 5:
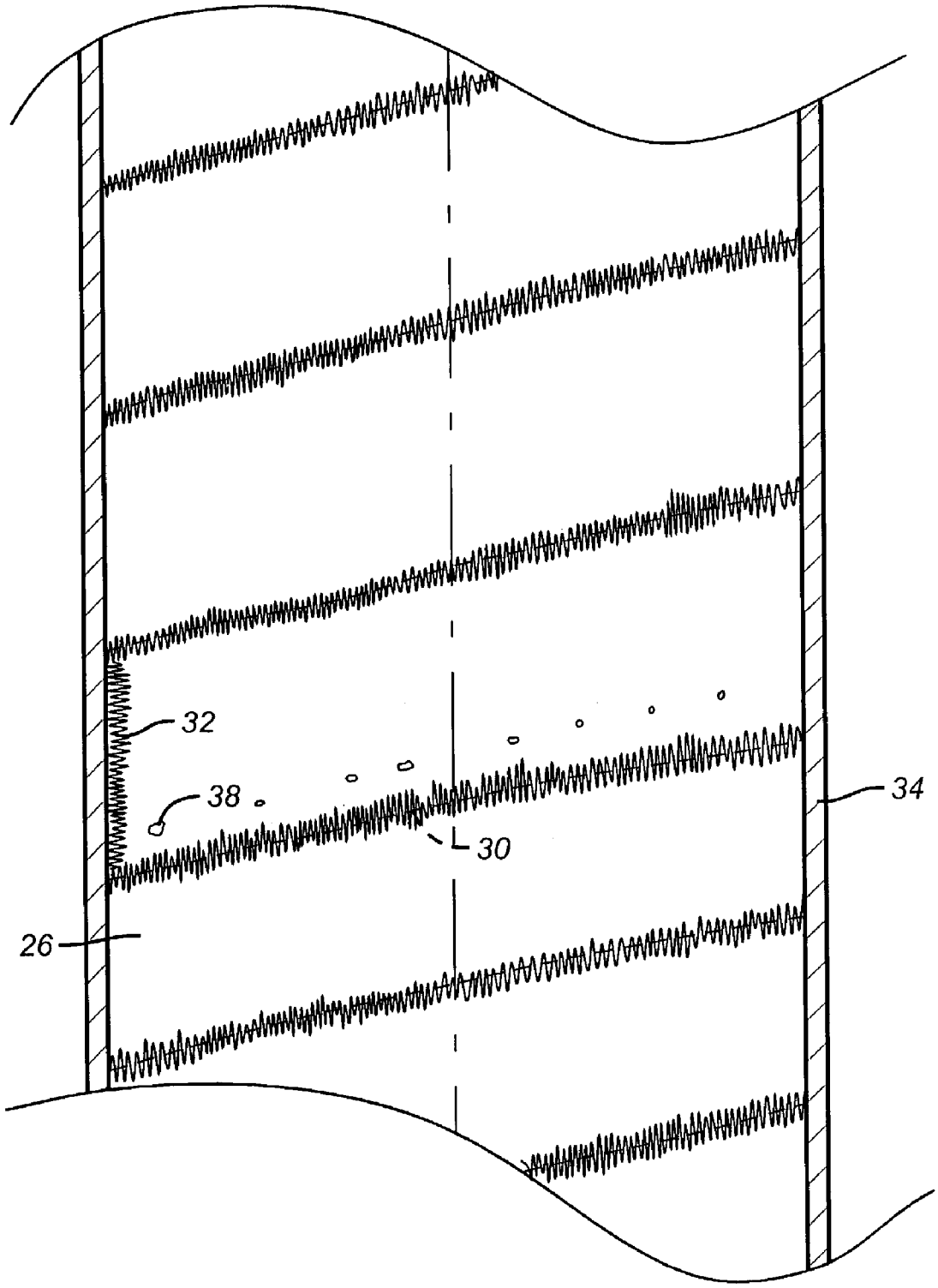
FIG. 5 is a view of the sealing element of FIG. 4 after compression showing the soft material filling in the peripheral leak paths.

Referring to FIG. 4, a portion of a sealing element 20 is illustrated surrounding a mandrel 22. The element 20 is preferably cured nitrile rubber but other elastomers or pliable materials that can withstand the well conditions as to pressure differential, chemical compatibility, and operating temperatures can also be used. The element is a cylindrical shape for run in and further comprises one or more grooves 24 formed on the outer surface 26. The depth, length, orientation and number of grooves 24 can vary with the application. The objective is to apply a sufficient amount of soft material 28, one example of which can be uncured or partially cured rubber, into the grooves 24. Alternative ways to assemble the device involve wrapping a soft or uncured rubber on mandrel 22, then cure it and then wrap an uncured rubber. The uncured rubber is preferably softer than the cured rubber but not necessarily. The two materials may be very close in hardness to each other. Compression downhole results in the formation of helical leak paths 30 (see FIG. 4) on the outer periphery 26 of the element 20, the soft material 28 distributes sufficiently in helical leak paths 30 as well as into any peripheral voids 32 in between wrappings of helical leak paths 30, as shown in FIG. 4. These peripheral voids 32 act like short circuit paths connecting portions of leak paths 30. Portions of the outer surface 26 can pull away from the casing or tubular 34 despite the significant longitudinal compressive forces that are applied. These void volumes can be part of a leak path between portions of helical leak paths 30 if not otherwise filled with the soft material 28. A sleeve 36 can overlay the soft material 28 to protect it from being forced out during run in if the element 20 contacts the easing 34. The sleeve 36 can be thin so that compression of the element 20 makes it break allowing the soft material to flow into the helical leak paths 30 or voids 32. The sleeve 36 can also dissolve or be subject to chemical interaction with well fluids as another of the various ways that it can be taken out of the way prior or during compression. Optionally, sleeve 36 can be ommitted. Instead of a sleeve 36 a spiral wrap can be used that simply snaps during compression of the element 20. The extent of coverage of the sleeve 36 or its equivalents described above is to extend over the soft material 28. Rather than breaking away, it can also be loosely mounted so as not to impede the flow of soft material 28, during compression of the element 20.

In the preferred embodiment grooves 24 are parallel to each other and run transversely to the longitudinal axis. However, the grooves 24 can be laid out spirally or even in a series of rings transversely to the longitudinal axis. Alternatively to grooves 24 the soft material can be injected into surface openings 38 so as to protect it during run in and to then allow the soft material 28 to be squeezed out during compression of the element 20. In this manner, sleeve 36 is not required. The soft material 28, preferably uncured rubber is meant to behave as a viscous fluid and fill the various leak paths. Partially cured rubber can be used and it may be further cured when pressed into leak paths 30 or voids 32. Other materials that exhibit those flow characteristics when the element is compressed can also be used. They will flow into the leak paths and seal them up insuring proper sealing of the element 20.

Grooves 24 can be added to element 20 after the rubber, which is the preferred material, is cured.

The foregoing disclosure and description of the invention are illustrative and explanatory thereof, and various changes in the size, shape and materials, as well as in the details of the illustrated construction, may be made without departing from the spirit of the invention.

I claim:

1. A sealing apparatus for selectively sealing a tubular downhole, comprising:

a mandrel;

a sealing element mounted to said mandrel and made of a first material, said sealing element, when compressed into contact with the tubular initially forms at least one leak path defined adjacent an outer surface thereof that extends between opposed ends thereof;

a second material on said outer surface of said sealing element and prior to compression of said sealing element is outside said leak paths which don't form until compression occurs said second material movable, as a result of said compression in a direction other than radially toward the tubular, with respect to said first material, to obstruct at least one leak path created between said first material and the tubular, when the first material is compressed into contact with the tubular.

2. The apparatus of claim 1, wherein:

said sealing element further comprises at least one groove in said outer surface thereof;

said second material is initially deposited in said groove.

3. The apparatus of claim 2, wherein:

said first material is harder than said second material.

4. The apparatus of claim 2, wherein:

said at least one groove comprises a plurality of grooves substantially parallel to each other and oriented transversely to a longitudinal axis of said sealing element.

5. The apparatus of claim 1, wherein:

said sealing element defines at least one cavity having an opening on said outer surface of said sealing element;

said second material initially deposited in said cavity.

6. The apparatus of claim 1, wherein:

said first material is harder than said second material.

7. The apparatus of claim 6, wherein:

said first material comprises an elastomer.

8. The apparatus of claim 7, wherein:

said first and second materials comprise nitrile rubber.

9. The apparatus of claim 1 , further comprising:

a cover over said second material.

10. The apparatus of claim 9, wherein:

said cover does not impede movement of said second material into said void when said sealing element is compressed.

11. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

said void comprises at least one spiral path on an outer surface of said sealing element; and said second material seals said spiral path.

12. The apparatus of claim 5, wherein:

said void comprises at least one auxiliary short circuit path extending from said spiral path; and said second material seals said auxiliary short circuit path.

13. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

said first material is harder than said second material;

said first material comprises an elastomer;

said first material comprises cured rubber and said second material comprises uncured rubber.

14. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

said first material is harder than said second material;

said first material comprises an elastomer;

said first material comprises cured rubber and said second material comprises partially cured rubber.

15. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

a cover over said second material;

said cover does not impede movement of said second material into said void when said sealing element is compressed;

said cover comes off said sealing element as a result of said sealing element being compressed.

16. The apparatus of claim 15, wherein:

said cover comprises a sleeve that breaks upon compression of said sealing element.

17. The apparatus of claim 15 wherein:

said cover comprises a sleeve that dissolves or is chemically attacked as said sealing element is positioned downhole.

18. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

said sealing element further comprises at least one groove in an outer surface thereof;

said second material is initially deposited in said groove;

said first material is harder than said second material;

said void comprises at least one spiral path on an outer surface of said sealing element; and said second material seals said spiral path.

19. The apparatus of claim 18, wherein:

a cover over said second material;

said cover does not impede movement of said second material into said void when said sealing element is compressed.

20. The apparatus of claim 19, wherein:

said cover comprises a sleeve that breaks upon compression of said sealing element.

21. The apparatus of claim 20, wherein:

said first material comprises cured rubber and said second material comprises uncured rubber.

22. A sealing apparatus for selectively sealing a tubular downhole, comprising:

a mandrel;

a sealing element mounted to said mandrel and made of a first material;

a second material on said sealing element and movable with respect to said first material, to obstruct at least one void created between said first material and the tubular, when the first material is compressed into contact with the tubular;

said sealing element further comprises at least one groove in an outer surface thereof;

said second material is initially deposited in said groove;

said at least one groove comprises a plurality of grooves substantially parallel to each other and oriented parallel to a longitudinal axis of said sealing element.

* * * * *